US005109363A

United States Patent [19]

Jones et al.

[11] Patent Number: 5,109,363

[45] Date of Patent: Apr. 28, 1992

[54] TRANSDUCER ASSEMBLY

[75] Inventors: Charles H. Jones, Pasadena; John H. Thompson, Severna Park; George R. Douglas, Arnold, all of Md.

[73] Assignee: Westinghouse Electric Corp., Pittsburgh, Pa.

[21] Appl. No.: 532,425

[22] Filed: Sep. 15, 1983

[51] Int. Cl.[5] ..... H04R 17/00

[52] U.S. Cl. ..... 367/151; 367/155; 367/165

[58] Field of Search ..... 367/151, 153, 155, 156, 367/157, 159, 162, 165, 173, 176

[56] References Cited

U.S. PATENT DOCUMENTS

| | | | |
|---|---|---|---|
| 2,728,515 | 12/1955 | Haire . | |
| 2,884,084 | 4/1959 | Sussman . | |
| 3,073,203 | 1/1963 | Evans . | |
| 3,145,679 | 8/1964 | Brooks | 367/153 |
| 3,230,504 | 1/1966 | Horan et al. . | |
| 3,243,768 | 3/1966 | Roshon, Jr. et al. | 367/151 |
| 3,353,150 | 11/1967 | Jacox | 367/155 |
| 3,409,869 | 11/1968 | McCool et al. | 367/153 |
| 3,489,994 | 1/1970 | Massa | 367/153 |
| 4,031,502 | 6/1977 | Lefaudeux et al. | 367/151 |
| 4,090,171 | 5/1978 | Bulmer . | |

OTHER PUBLICATIONS

"An onionskin composite as a transducer backing material", by Behrens et al.-Journal Acoustic Society of America, 65(6) Jun. 1979, p. 1652.

*Primary Examiner*—Harold J. Tudor
*Attorney, Agent, or Firm*—D. Schron

[57] ABSTRACT

A transducer assembly which includes a plurality of staves releasably arranged around the periphery of a torpedo. Each stave includes a transducer backing member such as foam polyurethane to simulate an air backing, and a solid acoustically transparent transducer support member, such as polyurethane, disposed in front of it. A curved reflector made up of a plurality of sheets of onionskin paper is positioned between, and compressed by, the backing and transducer support members. A plurality of transducer active elements is arranged vertically within the transducer support member with the arrangement imparting a certain desired directivity pattern to receiving beams associated with such apparatus.

18 Claims, 16 Drawing Sheets

70

TRANSDUCER ASSEMBLY

BACKGROUND OF THE INVENTION

1. Field of the Invention

The invention in general relates to passive sonar systems, and particularly to a transducer array for use in such systems.

2. Description of the Prior Art

Underwater vehicles such as submarines generally radiate a wide spectrum of noise due to propulsion machinery, propeller motion, turbulence, control apparatus and life support systems, by way of example.

Passive sonar systems are designed to respond to this generated noise so that appropriate action may be taken. In one proposed system, a passive sonar arrangement is mounted on a torpedo which falls vertically through the water column while listening for one or more particular frequencies and broad band noise which are known to be generated by the submarine.

The transducer array used with such passive sonar must be designed to discriminate against surface noise and to provide an indication of a target's bearing. In addition, the transducer array must be able to withstand high hydrostatic pressures which may be encountered. The transducer assembly of the present invention meets these desired objectives.

SUMMARY OF THE INVENTION

An underwater transducer assembly is provided for mounting on a curved structure such as a torpedo. The assembly includes a plurality of stave elements mounted around the periphery of the torpedo with each stave element including a transducer backing member having front and back concave surfaces. The backing member is of a pressure release material which can withstand high hydrostatic pressures, while simulating an air backing. The back concave surface of the backing member has a curvature to generally match that of the torpedo.

A solid, acoustically transparent transducer support member carries at least one transducer active element and includes front and back convex surfaces. The transducer support member is positioned in front of the backing member such that its convex back surface faces and generally matches that of the front concave surface of the backing member. The transducer support member may be disposed from the backing member with the space therebetween being occupied by a plurality of sheets of paper such as onionskin paper to act as an acoustic reflector. Means are provided for sealing these sheets of paper so as to prevent contact with the surrounding water environment.

DESCRIPTION OF THE PREFERRED EMBODIMENTS

Figure 1:
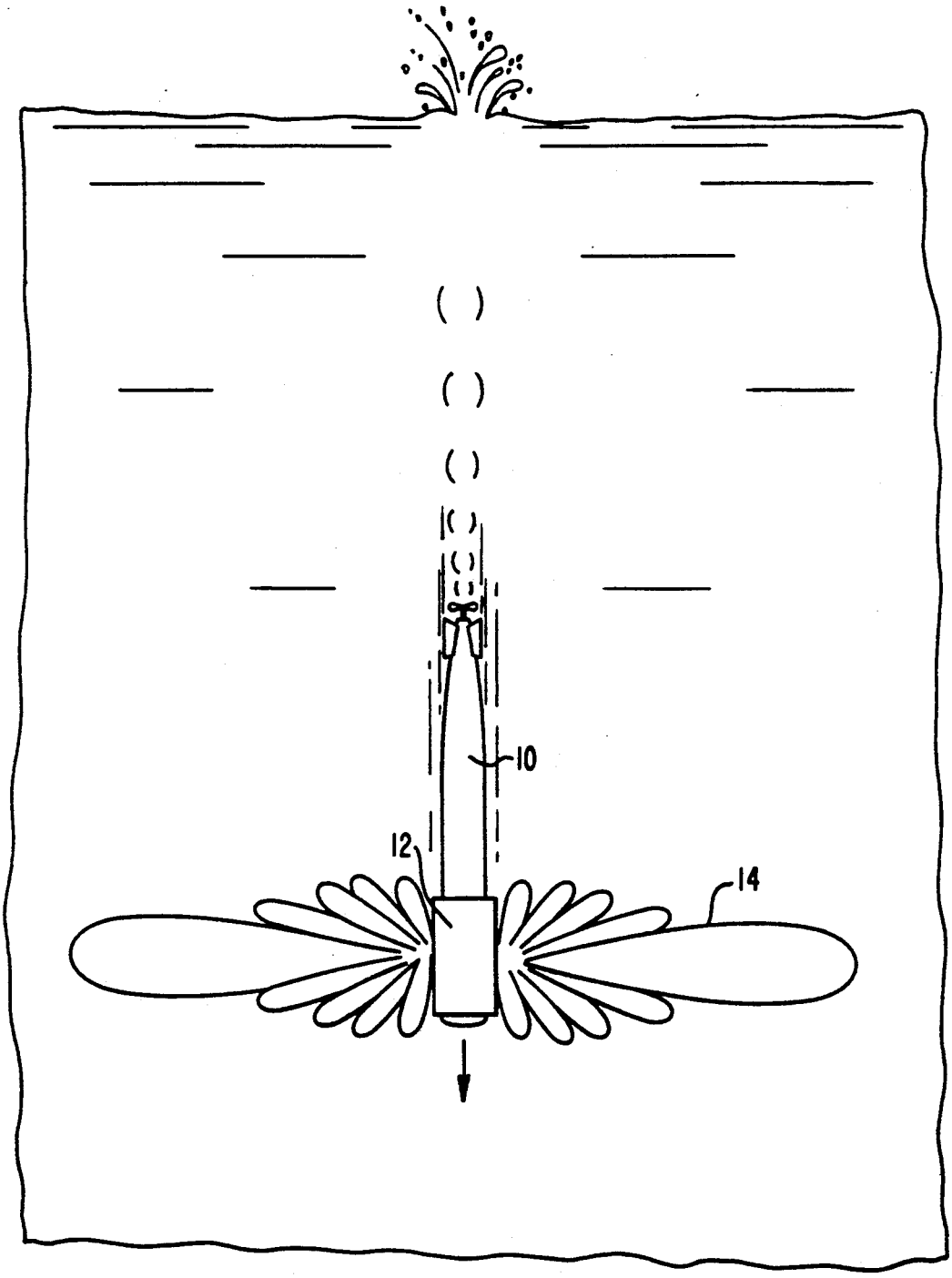
FIG. 1 illustrates a transducer apparatus for a passive sonar system mounted on a torpedo and further illustrates a desired vertical beam pattern.

FIG. 1 illustrates one use for the present invention. In FIG. 1, a torpedo 10 carrying a transducer array which is part of a passive sonar system, is traveling vertically through the water column having been delivered to the position such as by air dropping. As the torpedo travels through the water column, the passive sonar system searches for a distant target which generates noise within a certain frequency band from 6 to 16 kHz, by way of example.

Figure 2:
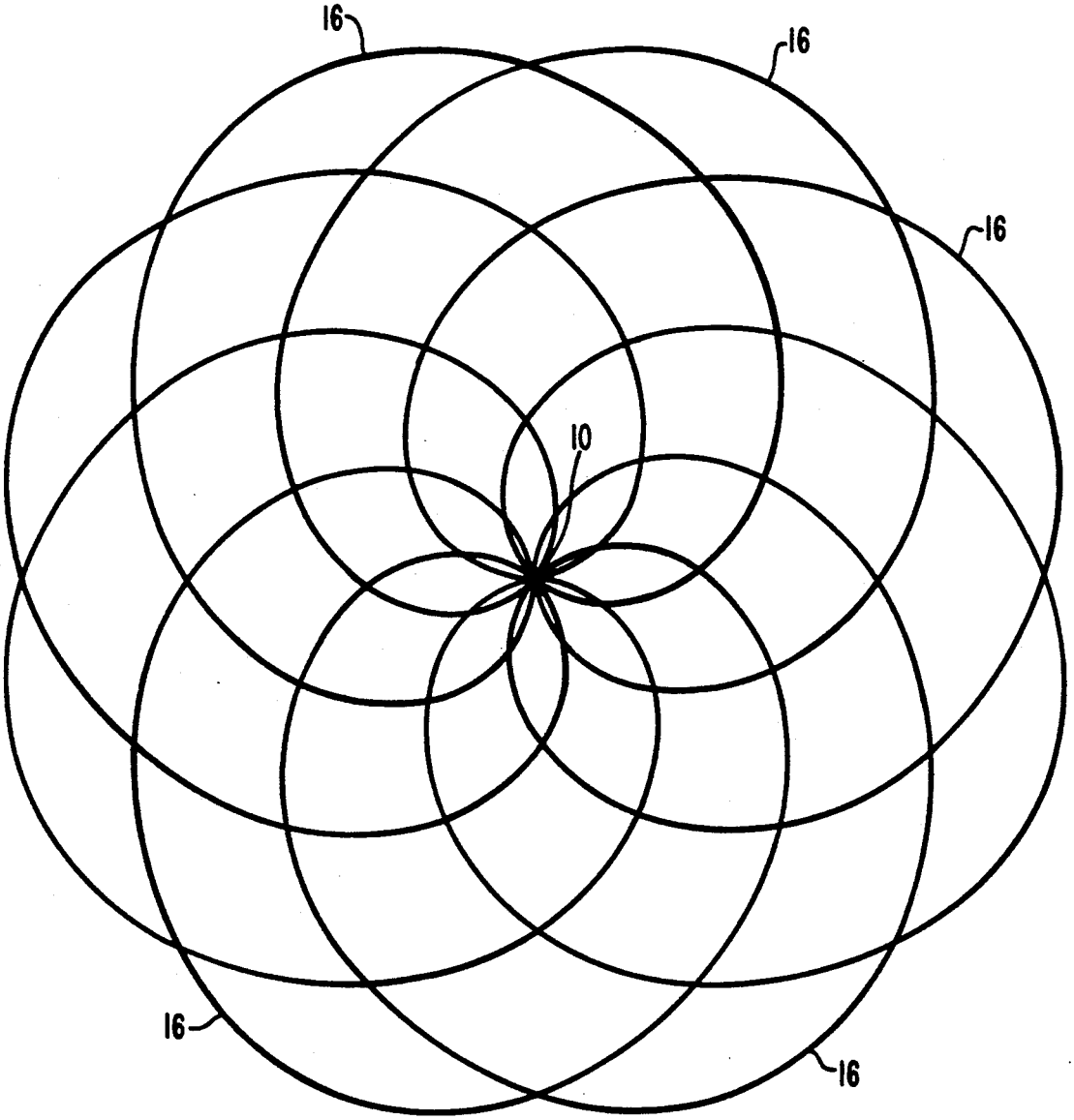
FIG. 2 illustrates the desired horizontal beam pattern for the arrangement of FIG. 1.

In order to discriminate against noise which may be reflected from the water surface, the vertical receiving beam pattern 14 is made relatively narrow, for example, less than 12°. In order that a target may be detected from any azimuth angle, a plurality of beams are formed around the torpedo, the horizontal beam pattern 16 being illustrated in FIG. 2 and having a horizontal beam width of 45°, by way of example.

Figure 3:
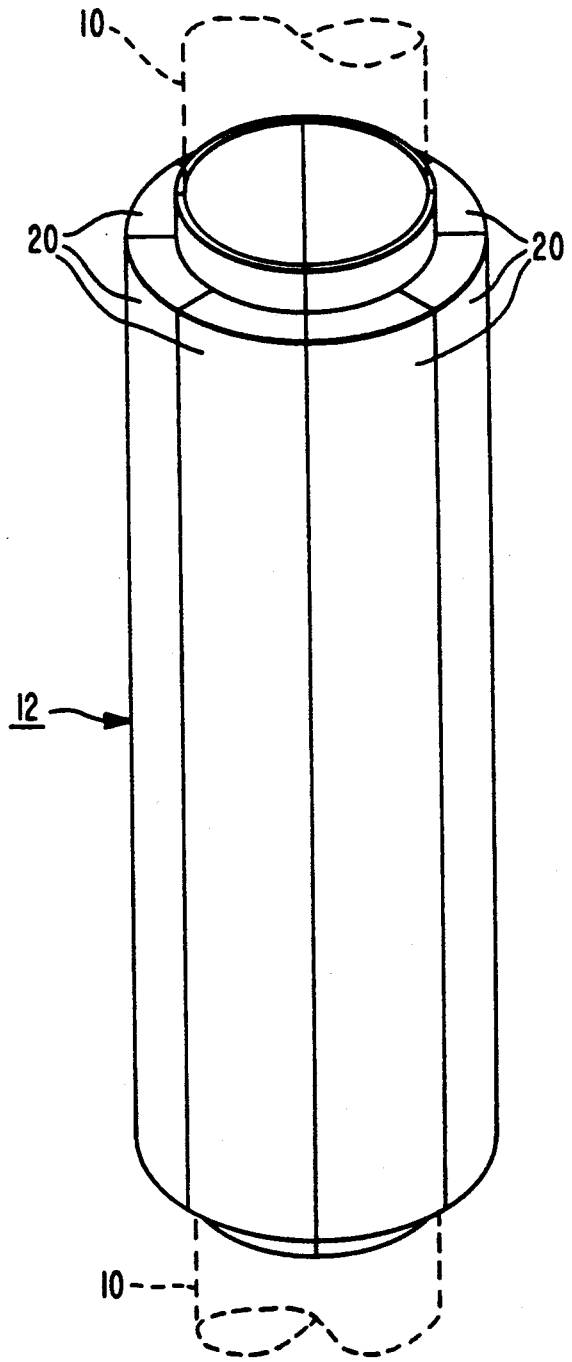
FIG. 3 is a more detailed view of the transducer array mounted on the torpedo of FIG. 1.
Figure 4:
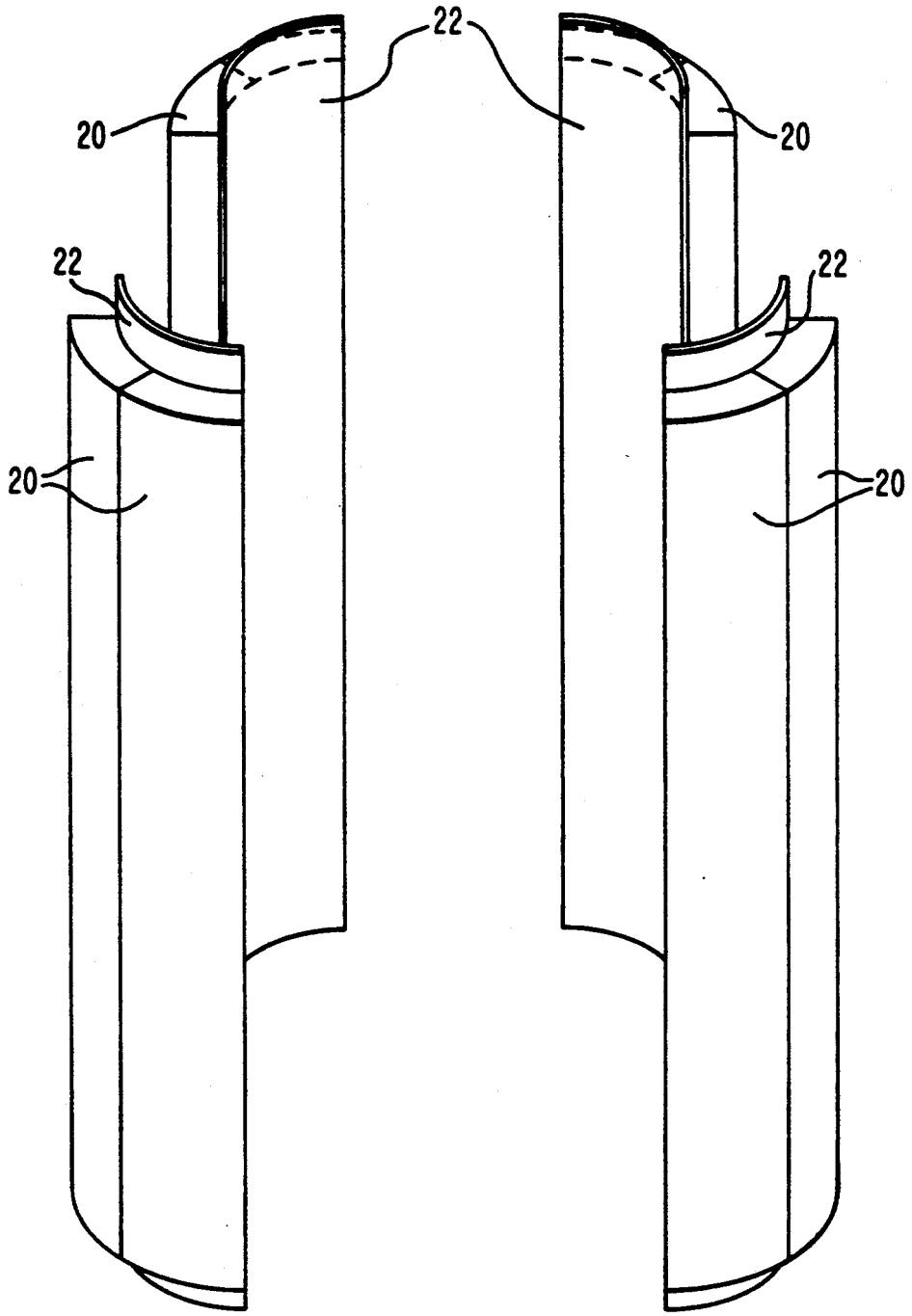
FIG. 4 illustrates the uncoupling of the transducer array.

As illustrated in FIG. 3, the transducer array 12 is made up of an assembly of vertical staves 20 arranged around the periphery of the torpedo 10. After a target has been detected, the staves are ejected, as depicted in FIG. 4. FIG. 4 additionally illustrates a plurality of thin metallic support plates 22 and, by way of example, two staves are mounted on one support plate, although such plates can be designed to accommodate a fewer or greater number of staves. The ejection mechanism, which forms no part of the present invention, may simply be releasable bands which hold the upper and lower projecting portions of support plates 22 to the torpedo until released.

The transducer portion of the system forms the subject matter of the present invention. The transducer assembly is designed to achieve the desired beam pattern illustrated in FIGS. 1 and 2 and to reduce the penetration of signals into the torpedo shell, with an assembly of minimal added weight and which can withstand the extremely high hydrostatic pressures which may be encountered.

Figure 5:
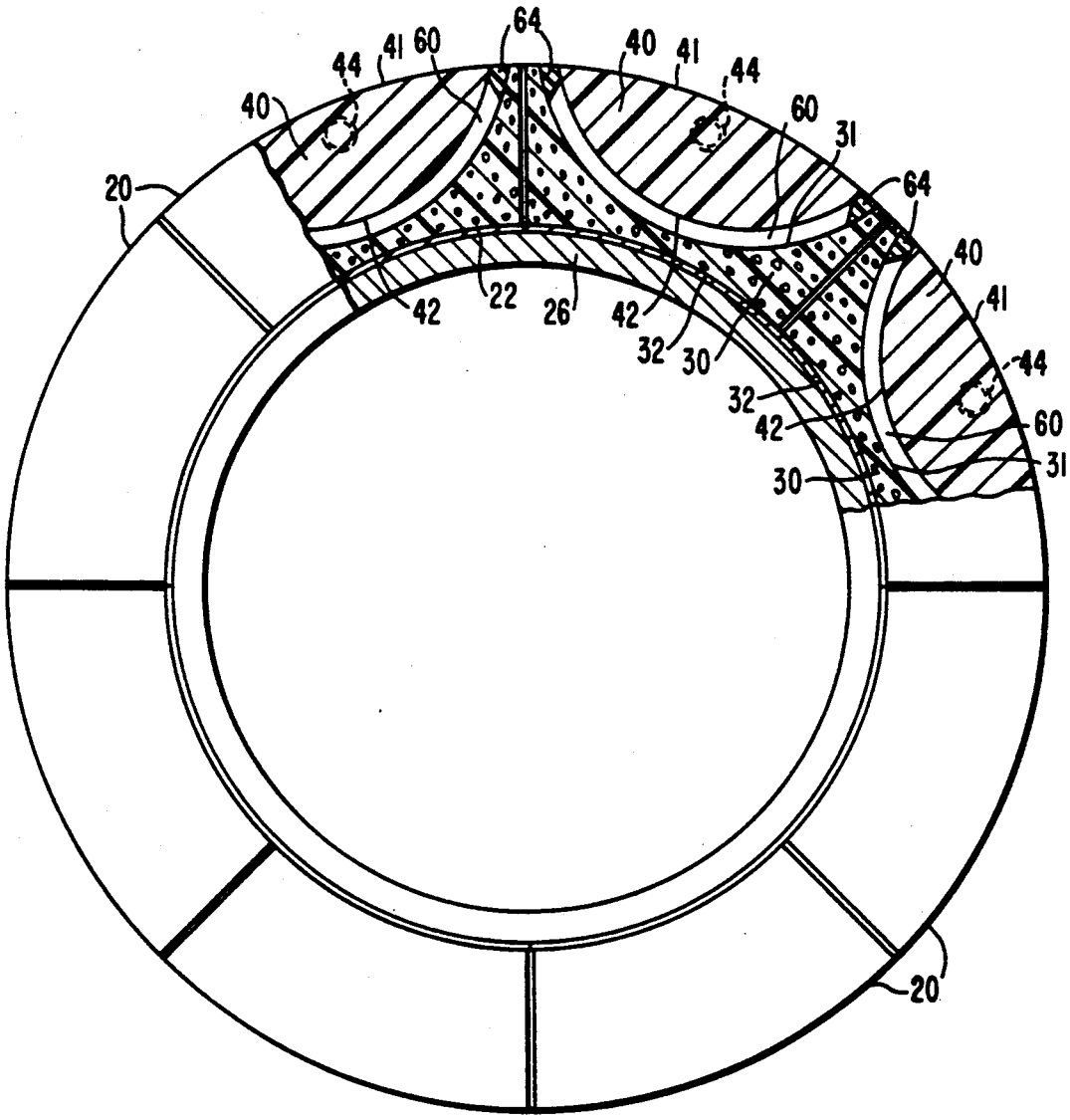
FIG. 5 illustrates a cross-sectional view of the transducer assembly of FIG. 3.
Figure 6:
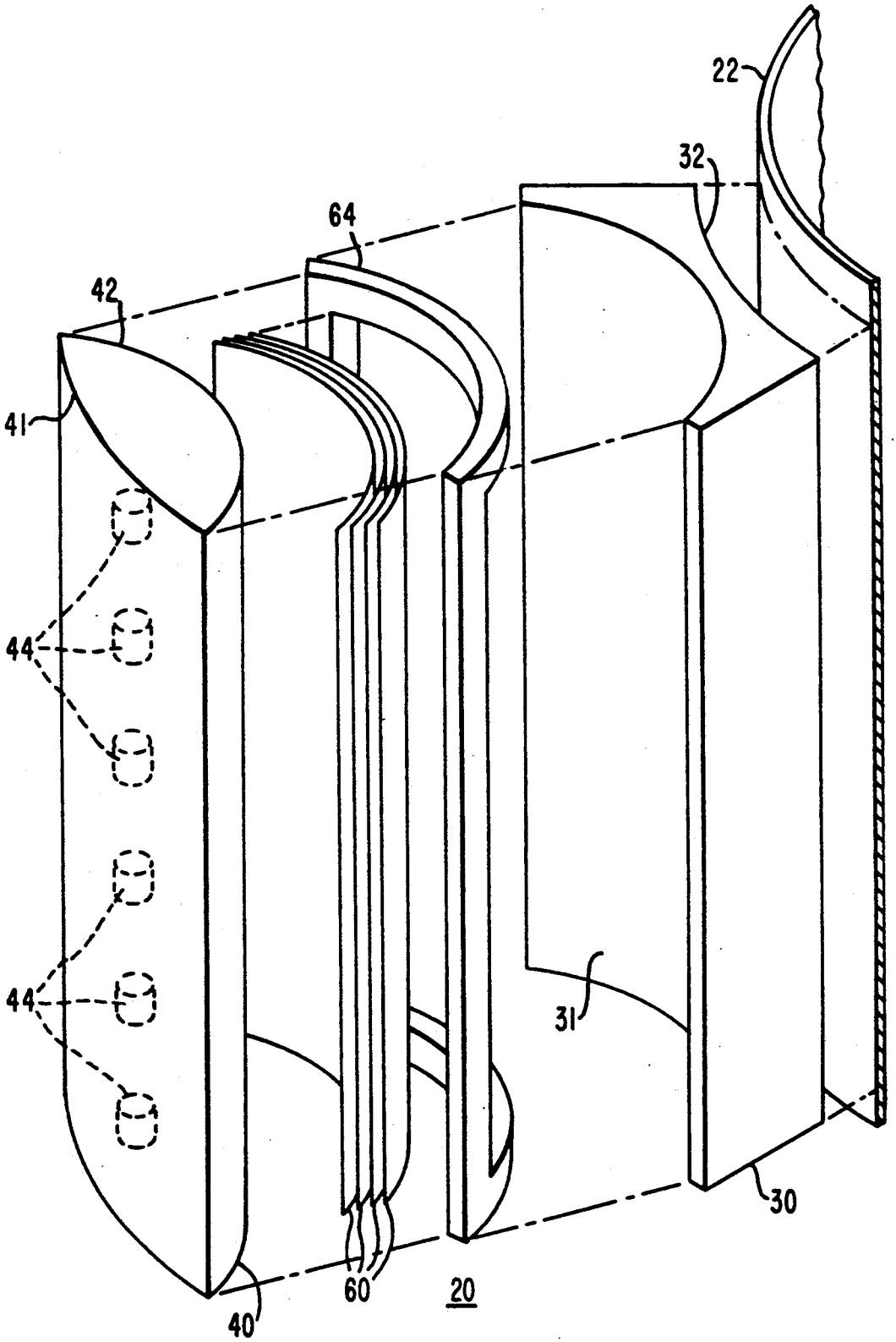
FIG. 6 is an exploded view of one stave element of the transducer assembly.

One embodiment of the present invention will now be described with reference to FIG. 5, showing a cross-sectional plan view of the apparatus, and FIG. 6 showing an exploded view of one stave element. As illustrated in FIGS. 5 and 6, each stave element includes a backing member 30 having front and back concave surfaces 31 and 32 with the back concave surface 32 having a particular curvature to generally match that of the support plate 22 and the shell 26 of the torpedo 10. Backing member 30 is of a material to simulate an air backing so as to reflect acoustic energy to prevent it from interacting with the torpedo shell 26. One material which serves this purpose is a closed-cell foamed polyurethane sold under the brand name of Eccofoam produced by Emerson and Cumming Corporation. The Eccofoam has a compressive strength of approximately 600 psi and a density of 14 lbs/ft$^3$. Another suitable material is syntactic foam. This is made by bonding together small hollow spheres of glass or ceramic. This has a density of about 40 lbs/ft$^3$ and will withstand pressure of 10,000 psi.

A transducer support member 40 includes front and back convex surfaces 41 and 42, with surface 41 defining the outer surface of the stave array, and surface 42 generally matching that of front surface 31 of backing member 30. Transducer support member 40 is a solid material which is acoustically transparent and may be formed of molded polyurethane. One or more transducer active elements 44 are positioned close to the front surface 41 of the support member 40. If the support member 40 is made by pouring liquid polyurethane into a mold, the active elements 44 may be correctly positioned within the mold prior to the pouring process. As an alternative, the active elements may be placed into a solidified polyurethane support member by machining out appropriate cavities for the active elements and thereafter filling in with polyurethane to close the cavities. The vertical spacing between active elements is preferably less than the in-water wavelength of the highest acoustic signal to be detected.

Figure 7A:
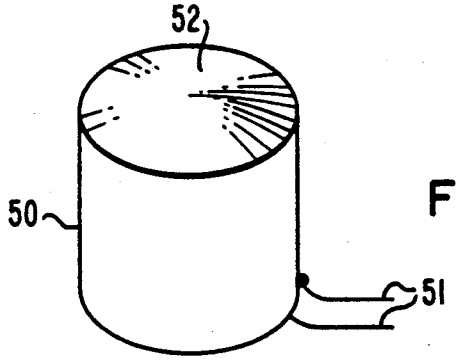
FIG. 7A to 7D illustrates one type of transducer element which may be utilized in the transducer assembly.
Figure 7B:
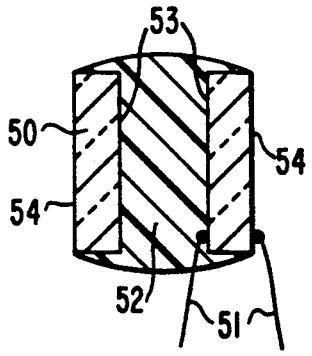

One type of transducer active element which may be utilized in the arrangement is illustrated in FIGS. 7A and the cross-section view of FIG. 7B to which reference is now made. The frequency range of interest was given by way of example to be 6 to 16 kHz. If a half-wave length thick ceramic resonator were used as the active element, operable at a 10 kHz resonant frequency, then the dimension of such element would be about six inches. For the intended purpose, the diameter of the transducer array must be kept to a minimum and the use of such transducer elements would add about a foot to the diameter. Accordingly, one type of active element which may be utilized herein is a piezoceramic cylinder 50 having an outside diameter as well as a length of approximately ½ inch. The cylinder 50 has a certain resonant frequency at which it is most efficient in providing its maximum output signal. However, as utilized herein, and as is well known, the active element is operated much below its resonant frequency where an output signal will still be provided, however at a much reduced amplitude level. This sacrifice in efficiency, however, allows for the use of an extremely small active element.

Figure 7C:
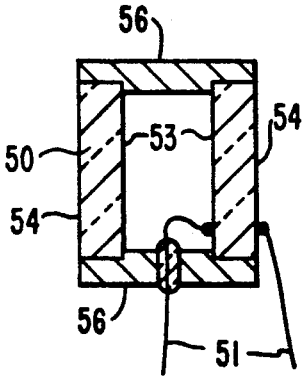
Figure 7D:
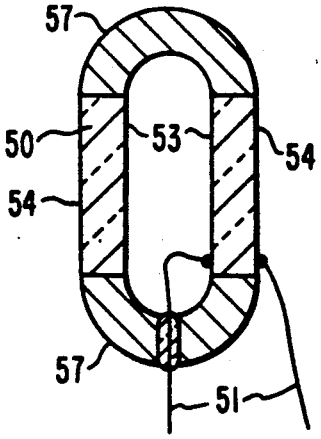

The outer and inner surfaces of the radially poled piezoceramic cylinder 50 are coated with conducting electrodes to which leads 51 are connected and the central portion thereof is filled with an epoxy 52 to exclude the polyurethane so as to improve the sensitivity of the unit. An alternate way to improve the sensitivity of the cylindrical ceramic elements is to provide a cap at each end of the cylinder as shown in FIGS. 7C and 7D (cross-section views). These caps may be ceramic or metal and should be bonded to the ceramic with epoxy or other adhesive. Ceramic is preferable to metal because there will be less stress on the bond due to thermal cycling. The pair of leads 51 must be attached to the inner and outer electrodes 53 and 54 of the cylinder. The lead from the inner electrode must be brought out through a hole in one of the end caps or through a hole in the cylinder. The end caps 56 in FIG. 7C are flat discs. The end caps 57 in FIG. 7D are hemispherical so they will withstand a large static pressure. Other transducer active elements such as spheres may be utilized in place of the cylinders and for some applications a single elongated transducer active element extending vertically down the stave may be utilized.

Referring once again to FIGS. 5 and 6, additional reflector means may be provided behind the column of transducer active elements. More particularly, a reflector in the form of a plurality of sheets of paper 60 is sandwiched between, and compressed by, the transducer support member 40 and backing member 30. In a preferred embodiment, the sheets are onionskin paper which can withstand the high ambient hydrostatic pressures. The shape of the reflecting area provides some beam focusing action which narrows the beam and increases the directivity of the transducer elements.

Means are provided for hermetically sealing the sheets of paper between the backing and support members 30 and 40. If the front surface of backing member 30 could be machined to accommodate the plurality of sheets of paper 60, then the sealing action may be performed by simply bonding the support member 40 to the backing member 30 such as by epoxy. If, however, the front surface of the backing member 30 is as illustrated by surface 31 in FIG. 6, then a sealing frame 64 may be provided to accommodate the sheets of paper with the sealing frame 64 being bonded to backing member 30 and support member 40, to exclude the water environment. The sealing frame 64 may be of polyurethane and, as an alternative, may be molded as an integral part of the polyurethane support member 40.

The sheets of onionskin paper form a cylindrical reflector which directs incoming acoustic energy to the active elements 44. These active elements are not at the focal point of the curve reflector, but are within it, to reduce the thickness of the stave. A certain directivity however is still imparted to the receiver beam which is formed. This directivity may be improved by utilizing reflectors of other shapes, several examples of which are illustrated in FIGS. 8A–8E to 11A–11E.

Figure 8A:
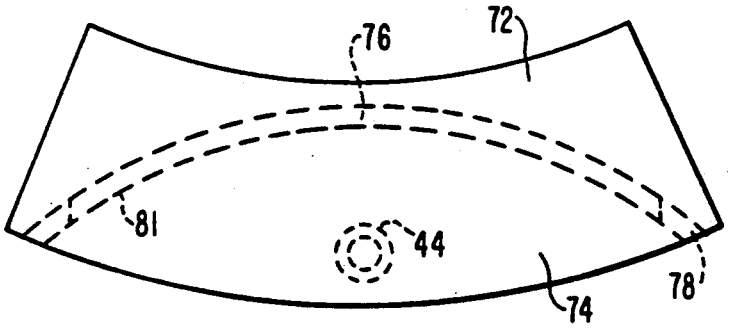
FIGS. 8A–8E, to 11A–11E illustrate alternate embodiments of the present invention.
Figure 8C:
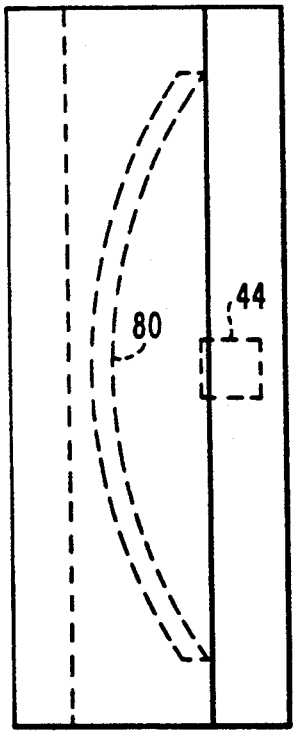
Figure 8B:
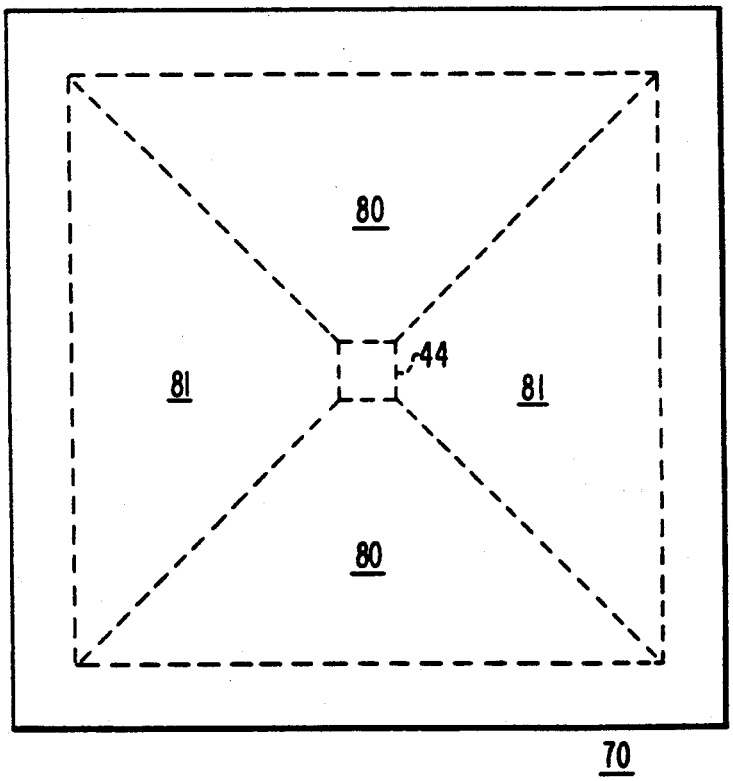
Figure 8D:
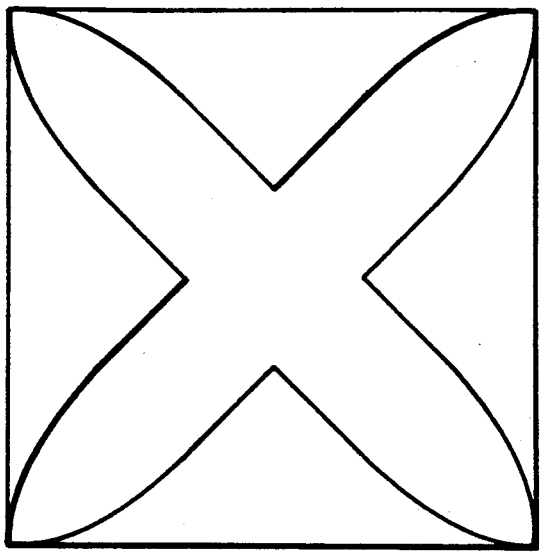
Figure 12:
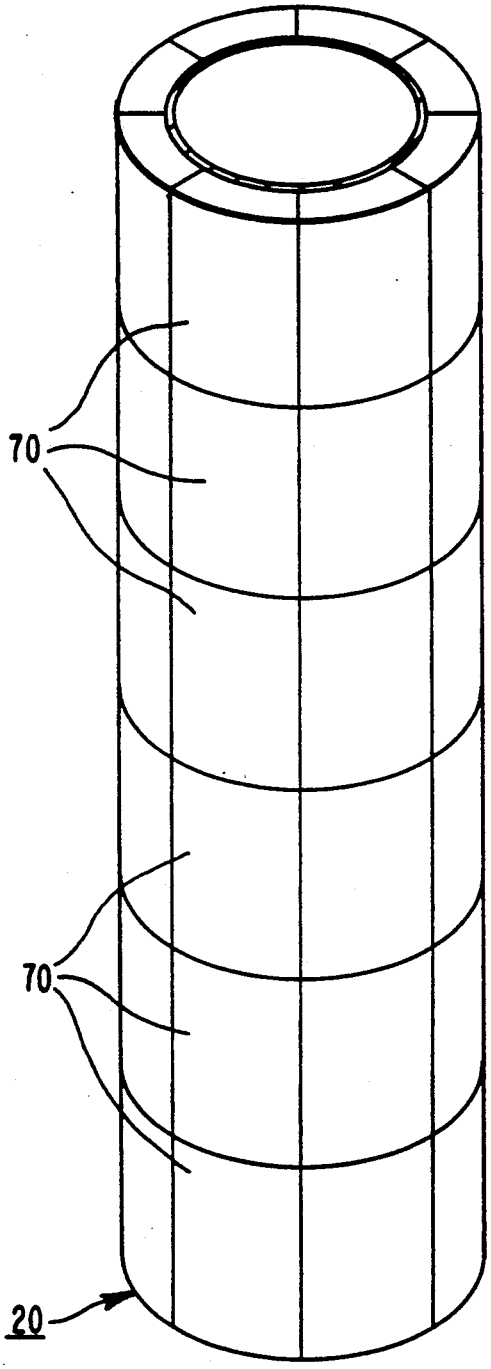
FIG. 12 illustrates an alternate stave arrangement.

FIG. 8A is a plan view, 8B a front view, and 8C a side view of a transducer module 70 wherein the reflector is made up of a plurality of sheets of onionskin paper initially cut to the shape illustrated in FIG. 8D. As illustrated in FIG. 12, each vertical stave 20 would be made up of a plurality of individual modules 70, six being illustrated by way of example.

The view illustrated in FIG. 8 is similar to that illustrated in FIG. 5 such that a backing member 72 in conjunction with an acoustically transparent transducer support member 74 sandwiches and compresses a reflector 76 made of a plurality of sheets of onionskin paper. A sealing means 78 serves to exclude the water environment.

Figure 8E:
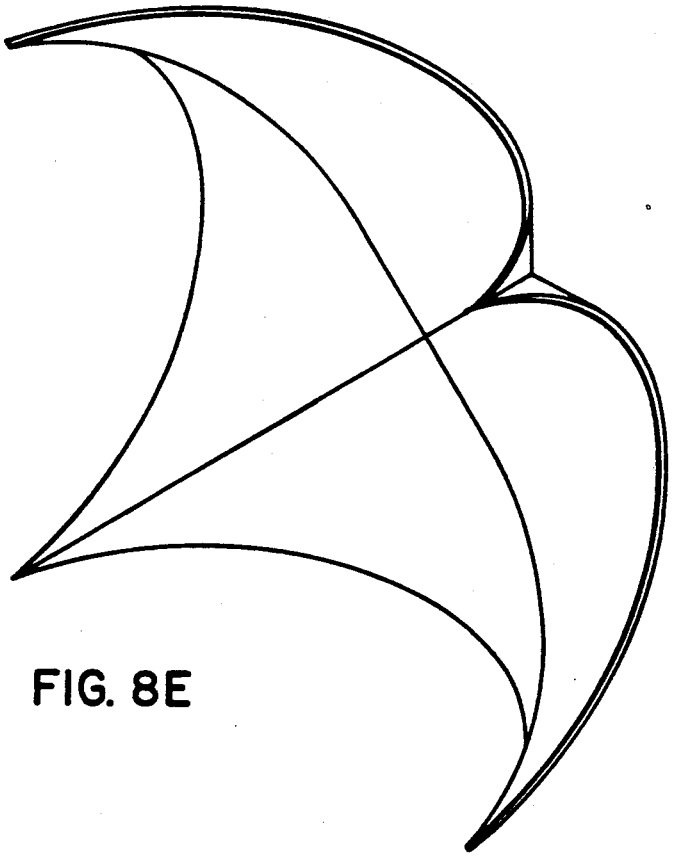

For the embodiment illustrated in FIGS. 8A–8E, however, the backing member 72 and transducer support member 74 are shaped to accommodate the particular curvature of the onionskin paper reflector. The reflector paper, as in FIG. 8D, is initially cut to the shape illustrated and when the seams of the cuts are joined, will result in a reflector as illustrated in FIG. 8E which defines two intersecting cylindrical surfaces 80 and 81. Consequently, some focussing is provided in elevation as well as in azimuth.

Figure 9A:
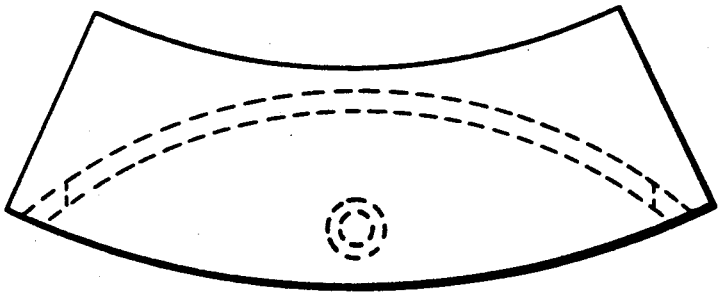
Figure 9B:
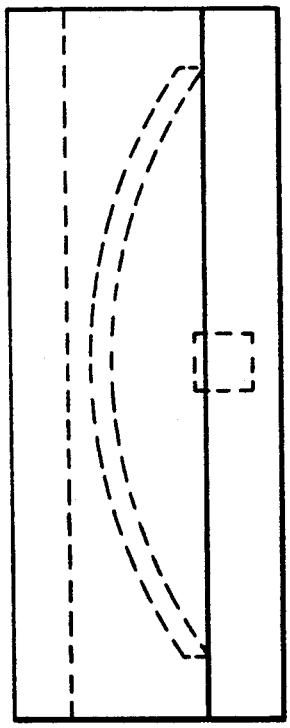
Figure 9C:
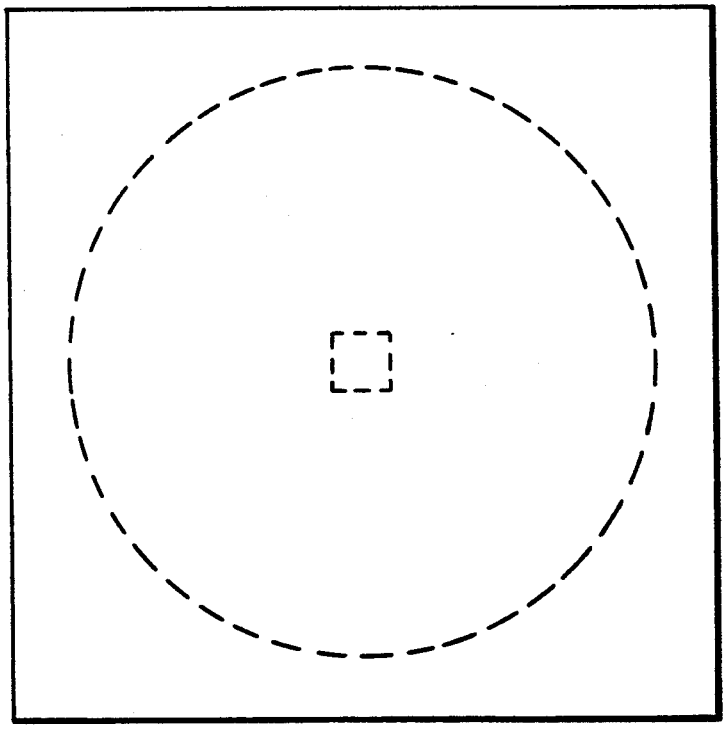
Figure 9D:
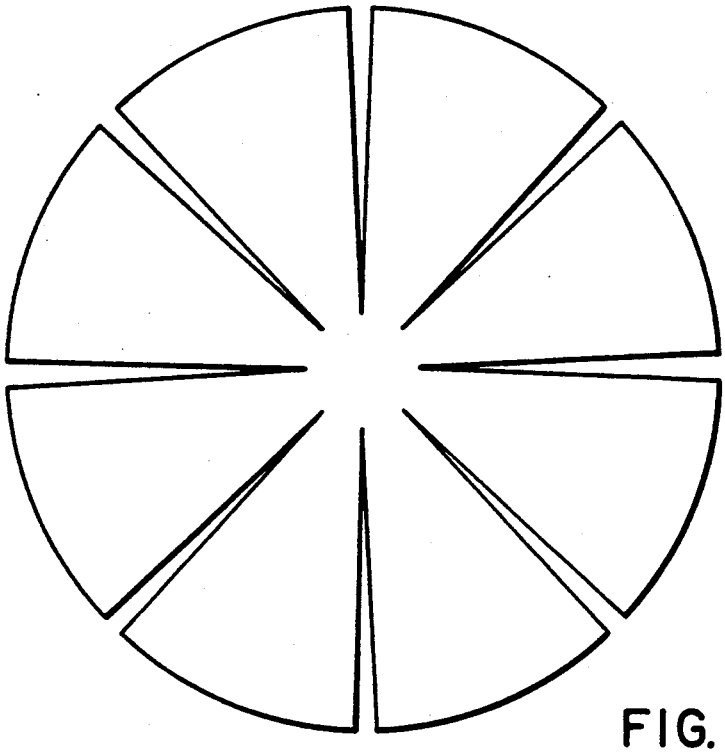
Figure 9E:
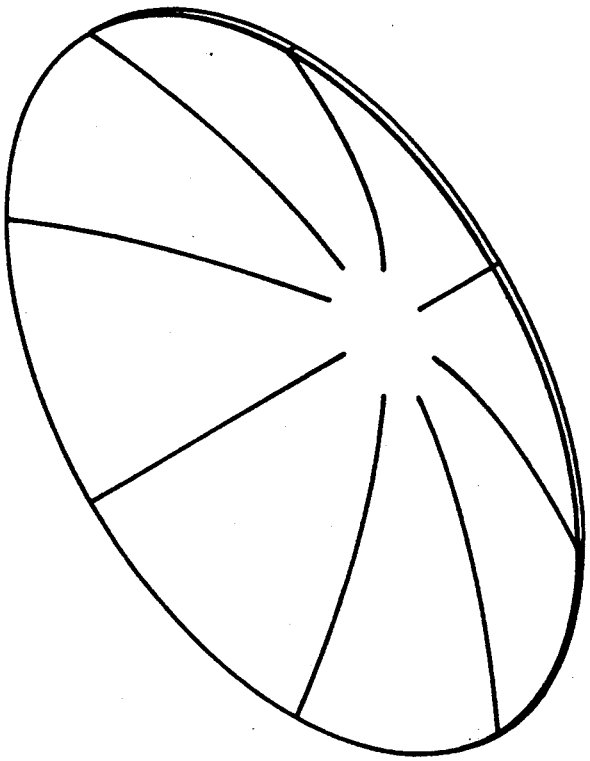

FIGS. 9A–9E are of a similar format as FIGS. 8A–8E except that the reflector sheets are cut as illustrated in FIG. 9D to form a spherical reflector as illustrated in FIG. 9E. The backing member and transducer support, accordingly, would also have complementary spherical shapes to accommodate the reflector.

Figure 10A:
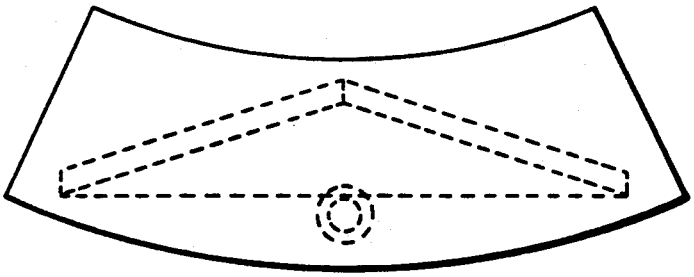
Figure 10C:
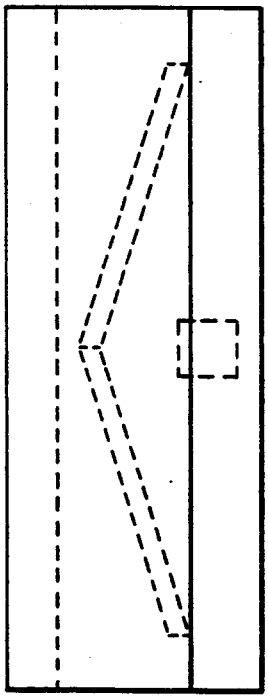
Figure 10B:
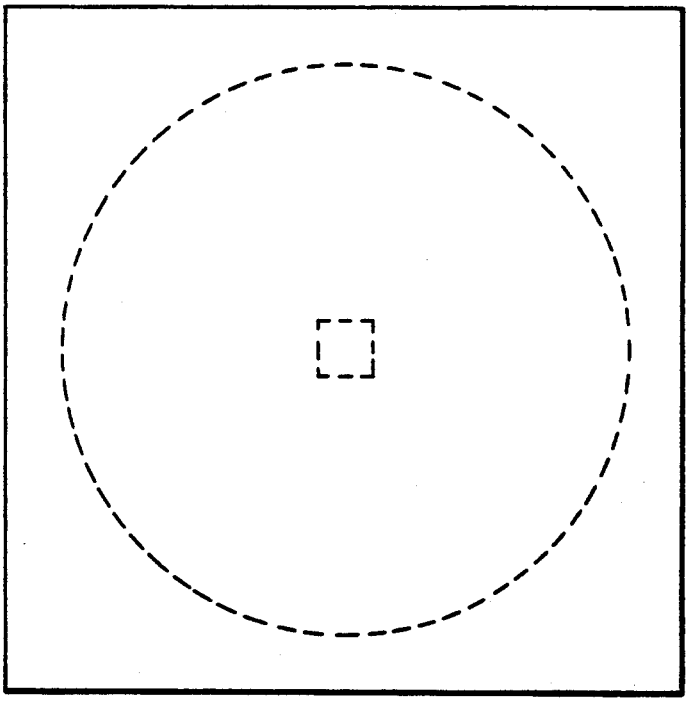
Figure 10D:
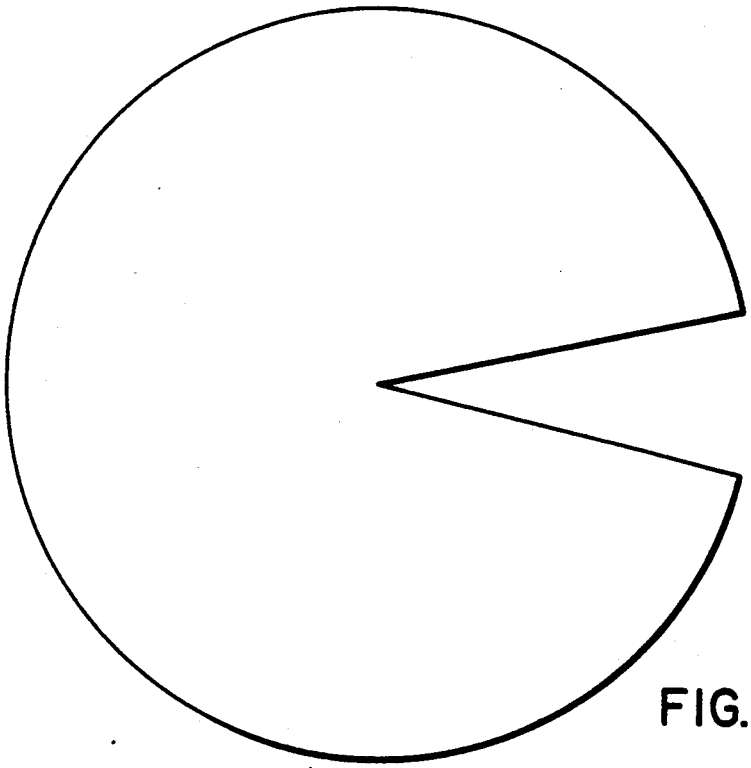
Figure 10E:
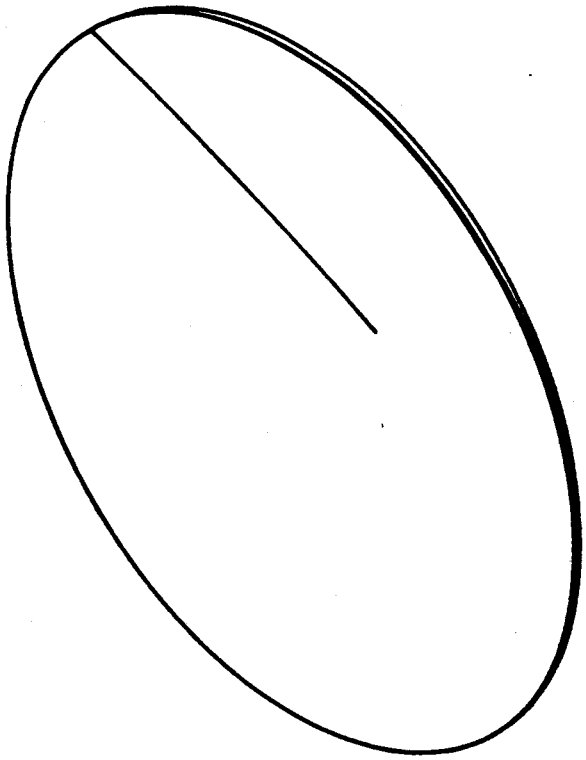
Figure 11A:
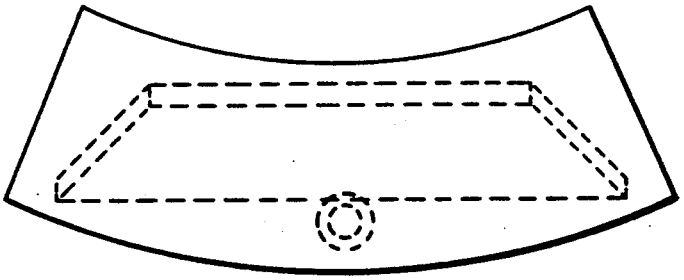
Figure 11C:
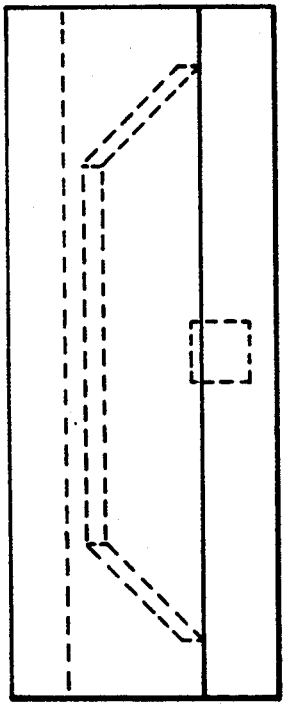
Figure 11B:
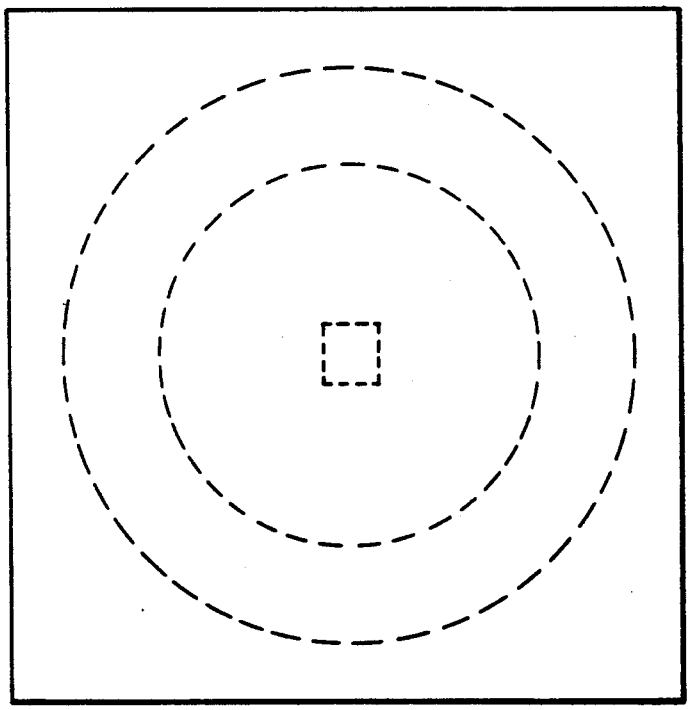
Figure 11D:
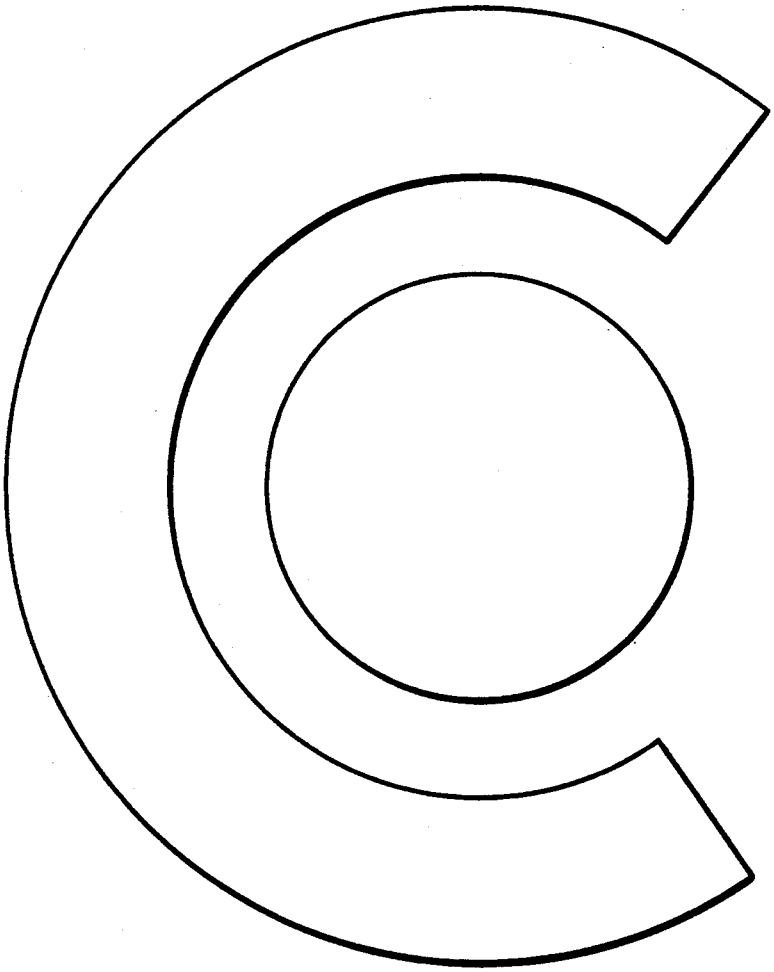
Figure 11E:
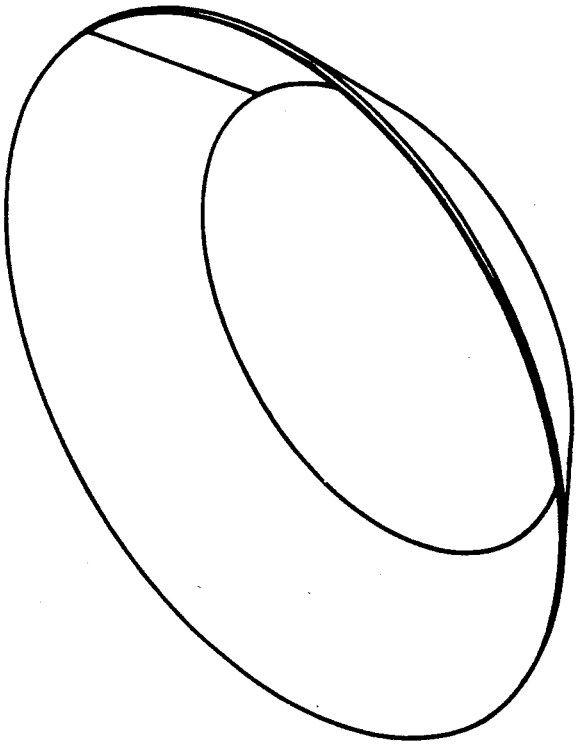

In a similar fashion, the module 70 illustrated in plan, front and side views of 10A–10C accommodate a conical reflector illustrated in FIG. 10E fabricated from sheets of onionskin paper having the form as illustrated in FIG. 10B. If the conical reflector is too deep, it may be truncated as illustrated in FIG. 11E and as formed from the onionskin paper pattern of FIG. 11D.

Although the various arrangements of FIGS. 8A–8E to 11A–11E may be somewhat more time consuming and difficult to fabricate, they would provide for a transducer array with somewhat better directivity and increased overall vertical gain.

All of the embodiments illustrated herein utilized by way of example a backing member of a foamed polyurethane material. This material will withstand high hydrostatic pressures and has a relatively low specific gravity of approximately 0.23 g/cm$^3$. This material when incorporated into the transducer assembly will impart a positive buoyancy to it so that the assembly will float upward and away from the torpedo when ejected, after a target has been detected and the direction is determined.

What is claimed is:

1. An underwater transducer assembly for mounting on a curved structure, comprising:

A) a plurality of stave elements mountable around the periphery of said curved structure;

B) each said stave element including:

i) a transducer backing member having front and back concave surfaces, with said back concave surface having a curvature to generally match that of said curved structure and being of a material to simulate an air backing so as to reflect acoustic energy, ii) a solid, acoustically transparent transducer support member having front and back convex surfaces, with said back convex surface having a curvature to generally match that of said front concave surface of said backing member, iii) at least one transducer active element positioned within said support member, iv) said support member being positioned in front of said backing member such that its back convex surface faces said front concave surface of said backing member.

2. Apparatus according to claim 1 which additionally includes:

A) a plurality of sheets of paper sandwiched between, and compressed by said support and backing members and including a front surface having a predetermined curvature so as to provide beam focusing to increase the directivity of said transducer active element, and B) means for sealing said plurality of sheets of paper to prevent contact with a surrounding water environment.

3. Apparatus according to claim 2 which includes

A) a plurality of transducer active elements arranged along the length of said stave element, B) the distance between one of said active elements and a subsequent one being less than the in-water wavelength of the highest acoustic signal to be detected.

4. Apparatus according to claim 2 wherein:

A) said transducer active element includes a hollow interior, and which includes B) a substance, other than said support member material, filling said hollow interior.

5. Apparatus according to claim 4 wherein:

A) said support member material is polyurethane; and

B) said substance is an epoxy.

6. Apparatus according to claim 2 wherein:

A) said backing member has a specific gravity less than that of water so that it is positively buoyant.

7. Apparatus according to claim 4 wherein:

A) said backing member is a closed-cell foamed polyurethane.

8. Apparatus according to claim 2 wherein:

A) said paper is onionskin paper.

9. Apparatus according to claim 8 wherein:

A) said plurality of sheets of paper form a generally cylindrical acoustic reflector.

10. Apparatus according to claim 1 wherein:

A) each said stave element is formed from a plurality of individual modules;

B) each said module including i) a transducer backing member having front and back concave surfaces, with said back concave surface having a curvature to generally match that of said curved structure and being of a material to simulate an air backing so as to reflect acoustic energy, ii) a solid, acoustically transparent transducer support member having front and back convex surfaces, with said back convex surface having a curvature to generally match that of said front concave surface of said backing member, iii) at least one transducer active element positioned within said support member, iv) said support member being positioned in front of said backing member such that its back convex surface faces said front concave surface of said backing member.

11. Apparatus according to claim 10 wherein each said individual module additionally includes:

A) a plurality of sheets of paper sandwiched between, and compressed by said support and backing members and including a front surface having a predetermined curvature so as to provide beam focusing to increase the directivity of said transducer active element, and B) means for sealing said plurality of sheets of paper to prevent contact with a surrounding water environment.

12. Apparatus according to claim 1 wherein:

A) said front concave surface of said backing member and said back convex surface of said support member define complementary spherical surfaces and B) said plurality of sheets of paper form a spherical acoustic reflector.

13. Apparatus according to claim 11 wherein:

A) said front concave surface of said backing member and said back convex surface of said support member define complementary conical surfaces; and B) said plurality of sheets of paper form a conical acoustic reflector.

14. Apparatus according to claim 11 wherein:

A) said front concave surface of said backing member and said back convex surface of said support member define complementary truncated conical surfaces; and B) said plurality of sheets of paper form a truncated conical acoustic reflector.

15. Apparatus according to claim 11 wherein:

A) said front concave surface of said backing member and said back convex surface of said support member define complementary surfaces, each of which consists of two cylindrical surfaces intersecting at right angles; and B) said plurality of sheets of paper form an acoustic reflector defined by two cylindrical surfaces intersecting at right angles.

16. Apparatus according to claim 1 wherein:

A) said curved structure is a torpedo.

17. Apparatus according to claim 16 wherein:

A) said stave elements are releasably connected to said torpedo and are released prior to contact with a target.

18. Apparatus according to claim 17 wherein:

A) said stave elements are positively buoyant so that they will float after release from said torpedo.

* * * * *